US007690417B2

(12) United States Patent
Mahapatra et al.

(10) Patent No.: US 7,690,417 B2
(45) Date of Patent: Apr. 6, 2010

(54) THIN CAST STRIP WITH CONTROLLED MANGANESE AND LOW OXYGEN LEVELS AND METHOD FOR MAKING SAME

(75) Inventors: Rama Ballav Mahapatra, Brighton-Le-Sands (AU); David J. Sosinsky, Whitestown, IN (US)

(73) Assignee: Nucor Corporation, Charlotte, NC (US)

( * ) Notice: Subject to any disclaimer, the term of this patent is extended or adjusted under 35 U.S.C. 154(b) by 674 days.

(21) Appl. No.: 11/469,686

(22) Filed: Sep. 1, 2006

(65) Prior Publication Data

US 2007/0079950 A1 Apr. 12, 2007

Related U.S. Application Data

(60) Continuation-in-part of application No. 11/419,684, filed on May 22, 2006, now Pat. No. 7,588,649, which is a division of application No. 10/761,953, filed on Jan. 21, 2004, now Pat. No. 7,048,033, which is a continuation-in-part of application No. 10/243,699, filed on Sep. 13, 2002, now abandoned.

(60) Provisional application No. 60/322,261, filed on Sep. 14, 2001.

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS 4,073,643 A 2/1978 Kumai et al.
4,152,140 A 5/1979 Hori et al.
4,468,249 A 8/1984 Lehman
4,746,361 A 5/1988 Pielet et al.
4,851,052 A 7/1989 Nishioka et al.
5,720,336 A 2/1998 Strezov (Continued)

FOREIGN PATENT DOCUMENTS

AU 80366/91 B 1/1992

(Continued)

OTHER PUBLICATIONS

PCT/AU2008/000064 International Search Report.

(Continued)

*Primary Examiner*—Kevin P Kerns
(74) *Attorney, Agent, or Firm*—Hahn, Loeser & Parks, LLP; Arland T. Stein

(57) ABSTRACT

A method for making a thin cast strip with reduced meniscus marks includes assembling a pair of casting rolls laterally positioned to form a nip therebetween, preparing molten steel having a carbon content in the range of 0.01 to 0.3% by weight, a manganese content between 0.1 and 0.8% by weight, a silicon content between 0.05 and 0.5% by weight, a calcium content between 0.0008 and 0.004% by weight, an aluminum content between 2 and 500 ppm by weight, having a free oxygen content below about 50 ppm at 1600° C., forming a casting pool of the molten steel supported on casting surfaces of the casting rolls above the nip, and counter-rotating the casting rolls cause thin strip to be casted downwardly from the nip.

6 Claims, 5 Drawing Sheets

U.S. PATENT DOCUMENTS

| | | | | |
|---|---|---|---|---|
| 5,840,206 | A | 11/1998 | Gacher et al. | |
| 5,857,514 | A | 1/1999 | Shook et al. | |
| 5,934,359 | A | 8/1999 | Strezov | |
| 6,059,014 | A | 5/2000 | Strezov | |
| 6,073,679 | A | 6/2000 | Strezov | |
| 6,491,089 | B1 * | 12/2002 | Poirier et al. | 164/480 |
| 6,547,849 | B2 | 4/2003 | Gross et al. | |
| 6,558,486 | B1 | 5/2003 | Strezov et al. | |
| 6,942,013 | B2 | 9/2005 | Strezov et al. | |
| 7,063,242 | B2 | 6/2006 | Marti et al. | |
| 7,588,649 | B2 * | 9/2009 | Blejde et al. | 148/320 |
| 2003/0111206 | A1 | 6/2003 | Blejde et al. | |
| 2004/0177944 | A1 | 9/2004 | Blejde et al. | |
| 2004/0177945 | A1 | 9/2004 | Blejde et al. | |
| 2005/0211411 | A1 | 9/2005 | Fukase et al. | |

FOREIGN PATENT DOCUMENTS

| | | | |
|---|---|---|---|
| EP | 0732163 | | 9/1996 |
| EP | 0850712 | B1 | 9/2001 |
| JP | 57134249 | | 8/1982 |
| JP | 62050054 | | 3/1987 |
| JP | 02205618 | | 8/1990 |
| JP | 03291139 | | 12/1991 |
| JP | 5-255861 | | 10/1993 |
| JP | 405255816 | | 10/1993 |
| JP | 7-034190 | | 2/1995 |
| JP | 2001-123245 | | 5/2001 |
| JP | 2001-342543 | | 12/2001 |
| JP | 2001-355039 | | 12/2001 |
| JP | 2003-129168 | | 5/2003 |
| JP | 2003-138340 | | 5/2003 |
| JP | 2004-018971 | | 1/2004 |
| JP | 2004-211157 | | 7/2004 |
| JP | 2005-298909 | | 10/2005 |
| KR | 2002-0040210 | | 6/2002 |
| KR | 2002-0048034 | | 6/2002 |
| KR | 2002-0048199 | | 6/2002 |
| WO | 1995013155 | | 5/1995 |
| WO | 9855251 | | 12/1998 |
| WO | 0007753 | | 2/2000 |
| WO | 0226422 | | 4/2002 |
| WO | 03024644 | | 3/2003 |
| WO | 2005031021 | | 4/2005 |
| WO | 2005/077570 | A1 | 8/2005 |
| WO | 2007/056801 | A1 | 5/2007 |
| WO | 2007/087686 | A1 | 8/2007 |
| WO | 2008/025096 | | 3/2008 |

OTHER PUBLICATIONS

PCT/AU2008/000064 Written Opinion.
PCT/AU2007/903665 International Search Report.
PCT/AU2007/001279 Written Opinion.
Samasekera et al., "Mould Heat Transfer and Solidification in the Continuous Casting of Steel Billets", Electric Furnace Conference Proceedings, 1985, vol. 42, pp. 249-274, ISSN: 0096-0128.
Brimacombe et al., Formation of Longitudinal, Midface Cracks in Continuously-Cast Slabs, Metallurgical Transactions B: Process Metallurgy, 1979, vol. 10B(2), pp. 279-292, ISSN: 0360-2141.
PCT/AU2007/001279 International Search Report.
ISR for AU2007-901274 dated Mar. 30, 2007.
International Preliminary Report on Patentability in PCT/AU2007/001279, Dec. 16, 2008.

* cited by examiner

THIN CAST STRIP WITH CONTROLLED MANGANESE AND LOW OXYGEN LEVELS AND METHOD FOR MAKING SAME

This application is a continuation-in-part application of Ser. No. 11/419,684, filed May 22, 2006, now U.S. Pat. No. 7,588,649 which is a divisional application of Ser. No. 10/761,953 filed Jan. 21, 2004, now U.S. Pat. No. 7,048,033, which is a continuation-in-part application of application Ser. No. 10/243,699, filed Sep. 13, 2002, now abandoned, which claims priority to and the benefit of U.S. Provisional Patent Application No. 60/322,261, filed Sep. 14, 2001, the disclosures of which are expressly incorporated herein by reference.

BACKGROUND OF THE INVENTION

This invention relates to the casting of steel strip and particularly to casting of steel strip using roll casters.

In a roll caster, molten metal is cooled on casting surfaces of at least one casting roll and formed into thin cast strip. In roll casting with a twin roll caster, molten metal is introduced between a pair of counter rotated casting rolls that are cooled. Steel shells solidify on the moving casting surfaces and are brought together at a nip between the casting rolls to produce a solidified sheet product delivered downwardly from the nip. The term "nip" is used herein to refer to the general region in which the casting rolls are closest together. In any case, the molten metal is usually poured from a ladle into a smaller vessel, from where it flow through a metal delivery system to distributive nozzles located generally above the casting surfaces of the casting rolls. In twin roll casting, the molten metal is delivered between the casting rolls to form a casting pool of molten metal supported on the casting surfaces of the rolls adjacent to the nip and extending along the length of the nip. Such casting pool is usually confined between side plates or dams held in sliding engagement adjacent to ends of the casting rolls, so as to dam the two ends of the casting pool.

When casting thin steel strip with a twin roll caster, the molten metal in the casting pool will generally be at a temperature of the order of 1500° C. and above. It is therefore necessary to achieve high cooling rates over the casting surfaces of the casting rolls. High heat flux and extensive nucleation on initial solidification of the metal shells on the casting surfaces is needed to form the steel strip. U.S. Pat. No. 5,720,336 describes how the heat flux on initial solidification can be increased by adjusting the steel melt chemistry such that a substantial portion of the metal oxides formed are liquids at the initial solidification temperature, and provide high heat flux during the casting campaign. As disclosed in U.S. Pat. Nos. 5,934,359 and 6,059,014 and International Application AU 99/00641, formation of the steel shells and strip can be influenced by the texture of the casting surface.

When casting steels in a thin strip casting process, manganese, silicon, chromium and aluminum are typically present at elevated oxygen levels. There is a tendency for the steel composition and slag composition to react with the refractoried used for the molten metal delivery system to distribute the liquid steel along the casting rolls. Specifically, the core nozzles and other refractory components are usually produced from a refractory material, such as alumina or zirconia combined in some proportion with a carbon source. The reaction of steel/slag compositions with the refractories produces carbon monoxide (CO) as a reaction product. The carbon monoxide gas formed as a result of the reaction disturbs the liquid steel pool just prior to solidification and forms waves on the surface of the molten metal in the casting pool. This disturbance can then be solidified in the strip and produces a defect referred to as a meniscus mark. Meniscus marks are defects that manifest as cracks on the steel strip surface. Meniscus marks are illustrated in FIG. 1.

SUMMARY OF THE INVENTION

We found that by controlling the levels of manganese, silicon, calcium, aluminum and chromium in the molten steel composition, along with free oxygen levels, steel strip can be produced that has unique surface properties and production qualities with reduced meniscus marks. The oxidation of carbon to form the CO bubble is caused by the reaction of MnO in the pool slag with the carbon contained in the core nozzle. In order to substantially reduce, if not eliminate this reaction from occurring, calcium is present to react with the oxygen present and lower the amount of MnO produced. By lowering the amount of MnO produced, the oxidation reaction between the MnO and carbon in the core nozzle is substantially reduced, and meniscus marks in the resulting thin cast strip are substantially reduced.

Specifically, we have found that by having soluble calcium between 5 and 40 ppm in this molten steel composition, the chemical reaction causing meniscus marks can be markedly reduced. That chemical reaction is $$MnO+C=CO+Mn$$

Calcium is not the only element that can accomplish this reaction. Aluminum, magnesium and titanium can form more stable oxides than manganese; however, the latter two elements are relatively expensive, and for that reason, are not of commercial use in making low carbon steel, while aluminum can be added economically. However, calcium is also needed to produce liquid inclusions to a provide appropriate levels of heat flux between the molten steel and the casting rolls.

There is provided a method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.1 and about 2.0% by weight, a silicon content between about 0.05 and about 0.5% by weight, a chromium content below about 10.0% by weight, a calcium content between about 8 ppm and about 40 ppm, an aluminum content between about 2 ppm and about 500 ppm by weight, having a free oxygen content below about 50 ppm at about 1600° C.;

c. forming a casting pool of the molten steel supported on casting surfaces of the casting rolls above the nip; and d. counter-rotating the casting rolls cause thin strip to be casted downwardly from the nip.

The molten steel may have a carbon content in the range of about 0.03 to about 0.045% by weight, a manganese content between about 0.3 and about 0.8% by weight, a silicon content between about 0.1 and about 0.3% by weight, a calcium content between about 8 ppm and about 40 ppm, an aluminum content between about 10 and about 90 ppm by weight, having a free oxygen content between about 10 and about 40 ppm at about 1600° C.

The casting surfaces of the casting rolls may be textured with a grit blast texture.

Alternatively, there is provided a method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.3 and about 0.8% by weight, a silicon content between about 0.05 and about 0.5% by weight, a calcium content between about 8 ppm and about 40 ppm, an aluminum content between about 2 ppm and about 500 ppm by weight, a chromium content below about 10.0% by weight, having a free oxygen content below about 50 ppm at about 1600° C.;

c. forming a casting pool of the molten steel supported on casting surfaces of the casting rolls above the nip; and d. counter-rotating the casting rolls cause thin strip to be casted downwardly from the nip.

In another alternative, a thin cast strip with reduced meniscus marks is made by the steps including:

a. assembling a pair of casting rolls laterally positioned to form a nip therebetween;

b. preparing molten steel having a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 500 ppm by weight, a chromium content below about 10.0% by weight, having a free oxygen content between about 10 ppm and about 40 ppm at about 1600° C.;

c. forming a casting pool of the molten steel supported on casting surfaces of the casting rolls above the nip; and d. counter-rotating the casting rolls cause thin strip to be casted downwardly from the nip.

In another alternative, a thin cast strip with reduced meniscus marks is made by the steps including:

a. assembling a pair of casting rolls laterally positioned to form a nip therebetween;

b. preparing molten steel having a carbon content in the range of about 0.01 to about 0.3% by weight, a manganese content between about 0.3 and about 0.8% by weight, a silicon content between about 0.05 and about 0.5% by weight, a calcium content between about 8 ppm and about 40 ppm, an aluminum content between about 2 ppm and about 500 ppm by weight, a chromium content below about 10.0% by weight, having a free oxygen content between about 10 and about 40 ppm at about 1600° C.;

c. forming a casting pool of the molten steel supported on casting surfaces of the casting rolls above the nip; and d. counter-rotating the casting rolls cause thin strip to be casted downwardly from the nip.

Alternatively, a steel composition may comprise:

a. a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 500 ppm by weight, a chromium content below about 10.0% by weight; and b. means for substantially avoiding the formation of meniscus marks during strip casting, the means comprising a free oxygen content below about 50 ppm at about 1600° C. in molten steel.

The steel composition may comprise:

a. a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 90 ppm by weight, a chromium content below about 10.0% by weight; and b. means for substantially avoiding the formation of meniscus marks during strip casting, the means comprising a free oxygen content below about 50 ppm at about 1600° C.

DETAILED DESCRIPTION

For continuous strip casting, it is desirable to have a sulfur content of the order of 0.009% or lower, although other sulfur levels may be useful. Following the desulfuriziation step generally in a ladle metallurgy furnace (LMF), the deoxidized and desulfurized molten steel is reoxidized typically in the ladle in preparation for casting. As a result, the reoxidized molten steel usually contains a distribution of oxide inclusions (typically inclusions with a mixture of MnO, CaO, $SiO_2$ and $Al_2O_3$) which influence the initial solidification of the molten metal and the formation of strip product exhibiting a characteristic distribution of solidified inclusions. Further details relating to the above-mentioned process are described in co-pending U.S. patent application Ser. No. 60/280,916 and U.S. patent application Ser. No. 60/322,261, both of which have been expressly incorporated herein by reference.

Figure 1:
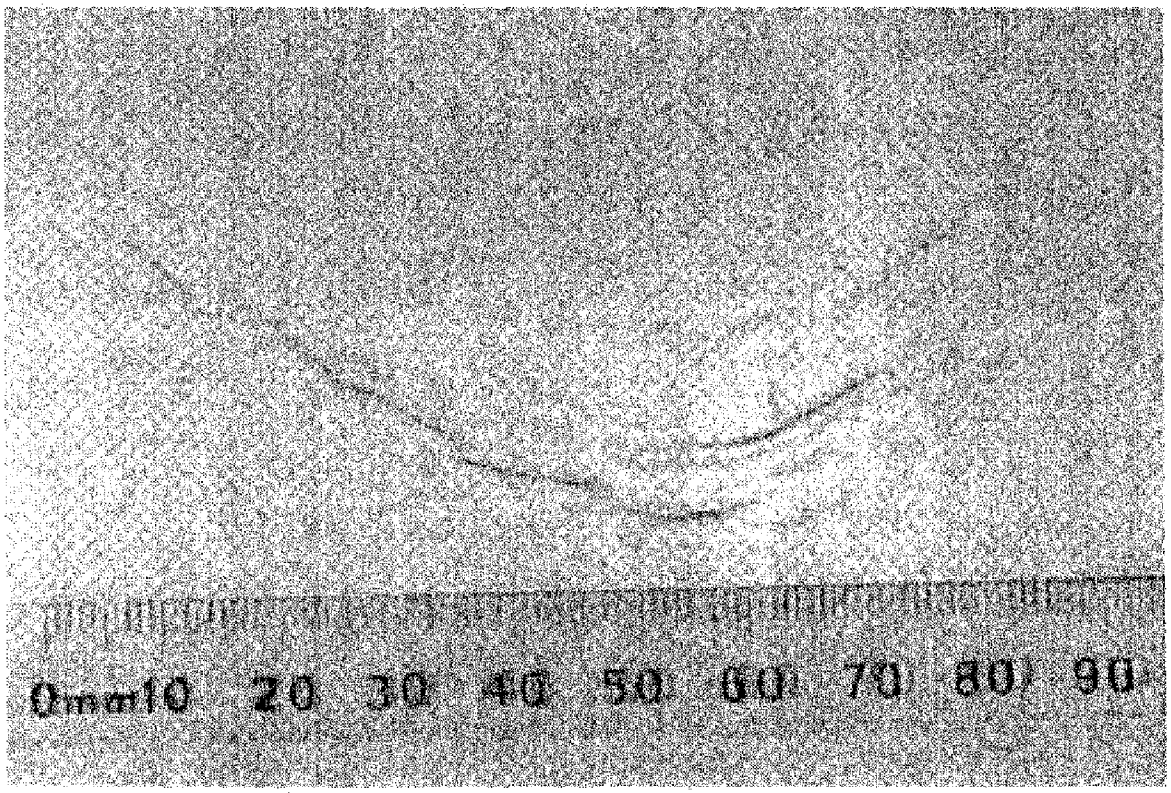
FIG. 1 Prior Art
FIG. 1 is a representative photograph of meniscus marks on the surface of a steel strip.
Figure 2:
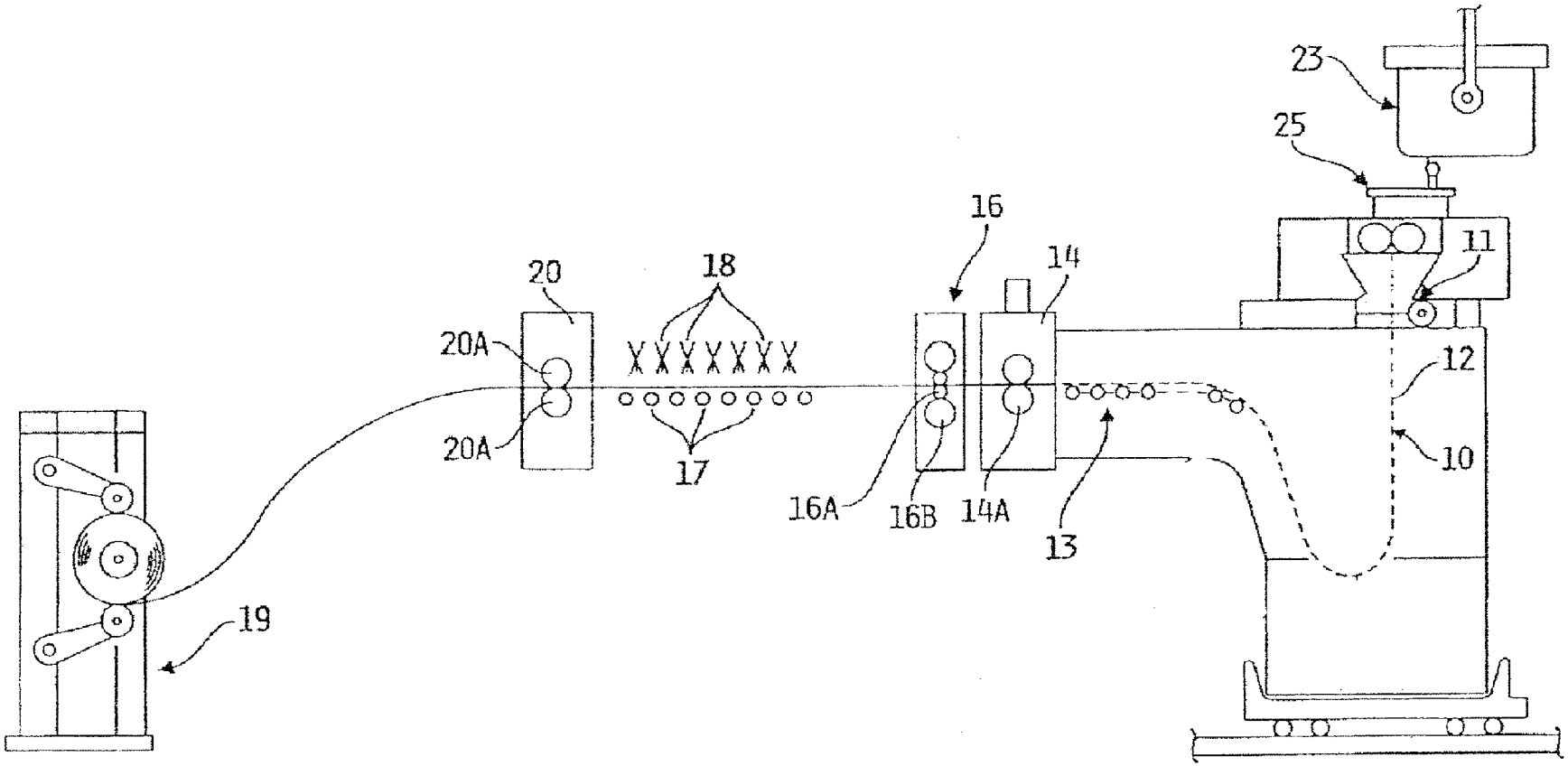
FIG. 2 is a diagrammatic side elevation view of an illustrative strip caster.
Figure 3:
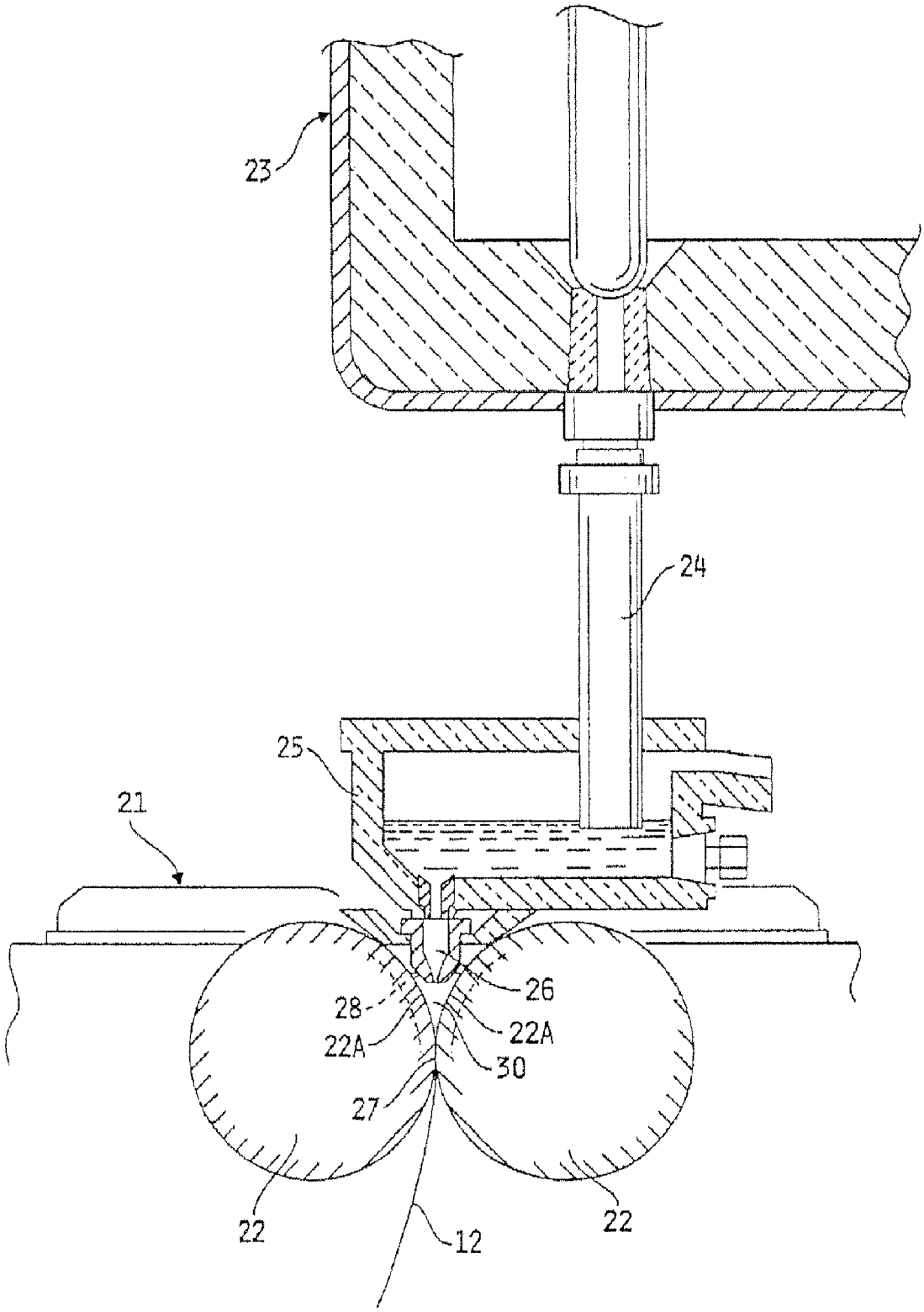
FIG. 3 is an enlarged sectional view of a portion of the caster of FIG. 2.

FIGS. 2 and 3 illustrate a twin roll continuous strip caster suitable to perform the present invention. The present invention is not limited, however, to the use of twin roll casters and extends to other types of continuous strip casters.

FIGS. 2 and 3 illustrate a twin roll caster generally identified as 11. The caster produces a cast steel strip 12 that passes in a transit path 10 across a guide table 13 to a pinch roll stand 14 comprising pinch rolls 14A. Immediately after exiting the pinch roll stand 14, the strip may pass into a hot rolling mill 16 comprising a pair of reduction rolls 16A and backing rolls 16B by in which it is hot rolled to reduce its thickness. The rolled strip passes onto a run-out table 17 on which it may be cooled by convection, radiation, and contact with water supplied via water jets 18 (or other suitable means). In any event, the rolled strip may then pass through a pinch roll stand 20 comprising a pair of pinch rolls 20A and then to a coiler 19. Final cooling of the strip generally takes place on and after the coiler, once the strip is coiled typically into 20 ton coils. The thin cast strip may be coiled at a temperature less than 900° C., and may be coiled at a temperature between about 800° C. and about 500° C.

As shown in FIG. 3, twin roll caster 11 comprises a main machine frame 21 which supports a pair of generally horizontally positioned casting rolls 22 having casting surfaces 22A, assembled side-by-side to form a nip 27 between them.

Molten metal may be supplied during a casting operation from a ladle (not shown) to a tundish 23, through a refractory shroud 24 to a distributor 25 and then through a metal delivery nozzle 26 generally above the nip 27 between the casting rolls 22. The molten metal so delivered forms a pool 30 supported on the casting roll surfaces 22A above the nip confined at the ends of the rolls by side closure dams or plates 28. The side dams 28 may be positioned adjacent the ends of the rolls by a pair of thrusters (not shown) comprising hydraulic cylinder units (or other suitable means) connected to the side plate holders. The upper surface of casting pool 30 is generally referred to as the "meniscus" level, and is generally above the lower end of the delivery nozzle during the casting operation, so that the lower end of the delivery nozzle is immersed within this casting pool 30.

Frame 21 supports a casting roll carriage which is horizontally movable between an assembly position and a casting position. In the casting position, casting rolls 22 may be counter-rotated through drive shafts (not shown) driven by an electric motor and transmission. Casting rolls 22 are water cooled. Rolls 22 have copper peripheral walls formed with a series of longitudinally extending and circumferentially spaced water cooling passages supplied with cooling water. The casting rolls may typically be about 500 to 600 mm in diameter, but be up to 1200 mm in diameter and larger. The casting rolls may be up to about 2000 mm long, and longer, in order to produce strip product of a desired width.

Tundish 25 is of conventional construction. It is formed as a wide dish made of any suitable refractory material, such as magnesium oxide (MgO). The tundish receives molten metal from the ladle, and is provided with an overflow spout and an emergency plug.

Delivery nozzle 26 is formed as an elongate body made of any suitable refractory material, such as alumina graphite. Its lower part may be tapered so as to converge inwardly and downwardly above the nip between casting rolls 22. Molten metal is capable of flowing from tundish 25 to the casting pool 30 through a series of spaced generally lateral flow passages in the delivery nozzles 26. The flow is a suitably low discharge velocity of molten metal along the length of the casting rolls, and to deliver the molten metal onto the casting roll surfaces where initial solidification occurs.

The casting pool 30 may be confined at the ends of the casting rolls by a pair of side dams 28 held against stepped ends of the rolls, when the casting rolls are at casting position. Side dams 28 are illustratively made of a suitable refractory material, for example boron nitride or zirconia graphite, and upon wear in, has side edges that match the curvature of the stepped ends of the casting rolls. The side dams can be mounted in plate holders which are movable at the casting position by actuation of a pair of hydraulic cylinder units or other suitable means, to bring the side dams into position after preheating to form end closures for the molten pool of metal formed on the casting rolls during a casting operation.

In the casting operation, the flow of metal is controlled to maintain the casting pool 30 at a level such that the lower end of the delivery nozzle 26 is submerged in the casting pool. The lateral flow passages of the delivery nozzle may be disposed immediately beneath the surface of the casting pool. The molten metal flows through the flow passages in two laterally outwardly directed streams in the general vicinity of the casting pool surface and to impinge on the cooling surfaces of the casting rolls in the vicinity of the pool surface. This maintains the temperature of the molten metal delivered to the meniscus regions of the casting pool.

In the casting pool 30, as the casting rolls are counter rotated, metal shells solidify on the moving casting surfaces of the casting rolls as heat is extracted from the molten metal through the water cooling system of the casting rolls. The shells are brought together at the nip 27 between the casting rolls, to produce solidified thin strip 12 which is delivered downwardly from the nip.

The twin roll caster may be of the kind illustrated and described in some detail in, for example, U.S. Pat. Nos. 5,184,668; 5,277,243; 5,488,988; and/or 5,934,359; U.S. Pat. application Ser. No. 10/436,336; and International Patent Application PCT/AU93/00593, the disclosures of which are incorporated herein by reference. Reference may be made to those patents for appropriate constructional details but forms no part of the present invention.

Extensive casting trials have been conducted on a twin roll caster of the kind fully described in U.S. Pat. Nos. 5,184,668 and 5,277,243 to produce steel strip of the order of 1.8 mm thick and less. Such casting trials using silicon manganese killed steel have demonstrated that the melting point of oxide inclusions in the molten steel have an effect on the heat fluxes obtained during steel solidification. Low melting point oxides improve the heat transfer contact between the molten metal and the casting roll surfaces in the upper regions of the casting pool, generating higher heat transfer rates.

Through various trials, it has been found that strip with reduced meniscus marks can be produced by preparing molten steel for casting having a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 500 ppm by weight, a chromium content below about 10.0% by weight, having a free oxygen content below about 50 ppm at about 1600° C.

Figure 4:
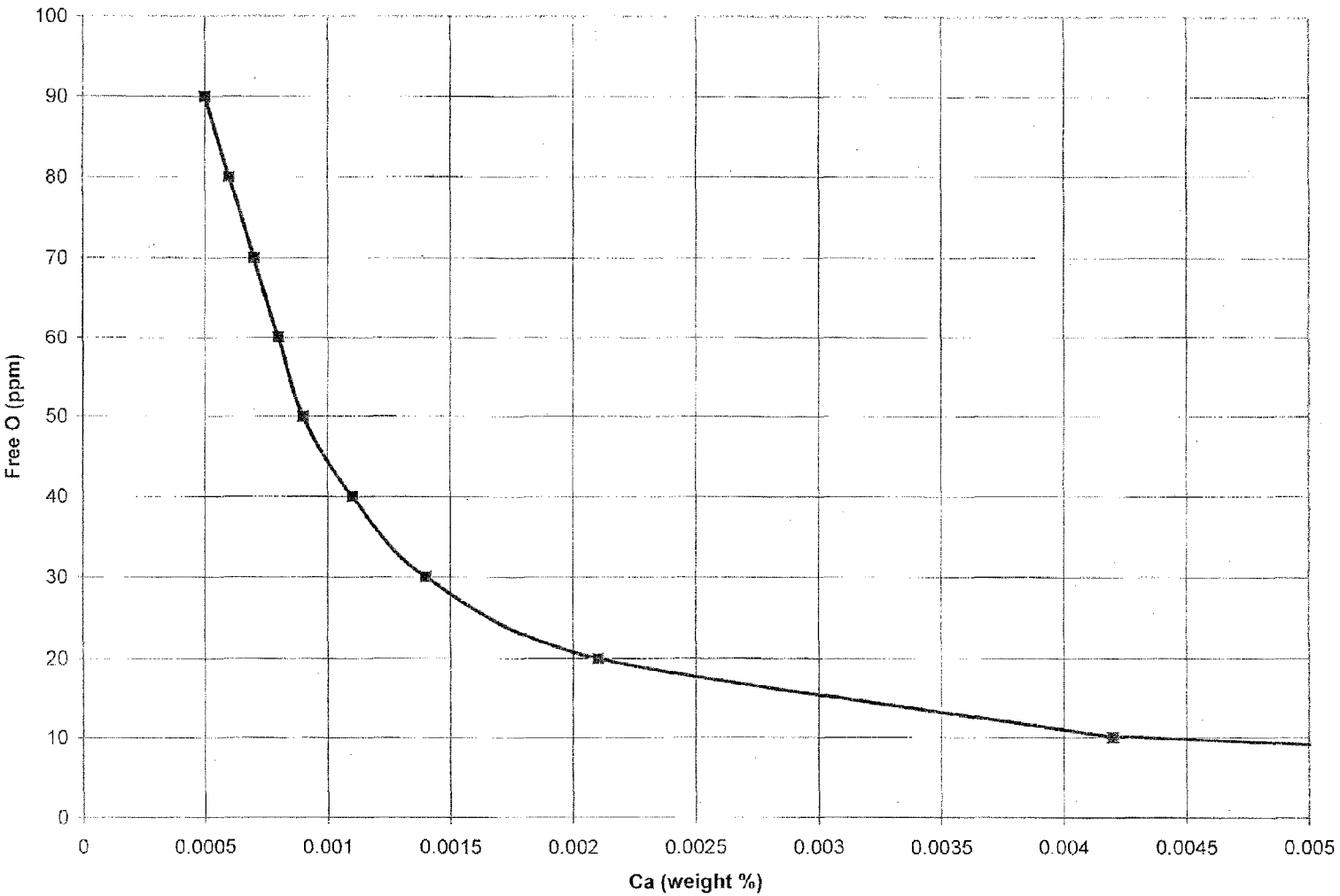
FIG. 4 is a chart showing the relationship between calcium levels free oxygen levels in the thin cast strip.

Further, FIG. 4 shows relationship of the amount of calcium results to the amount of free oxygen in the molten steel. As indicated, amount of calcium can be used to control the levels of free oxygen in solution the molten metal below 50 ppm, with lower amounts of free oxygen down to 12 ppm provide with higher levels of calcium up to 0.004% by weight.

It was found in casting trials that by controlling the manganese, silicon, calcium, aluminum, chromium, and free oxygen levels in the molten steel composition, steel strip having unique surface properties and production qualities can be produced with reduced meniscus marks in the cast strip. Meniscus marks are initiated at the meniscus level of the casting pool where initial metal solidification occurs. Reactions at the nozzle interface can result in the evolution of carbon monoxide bubbles which cause disturbances at the meniscus resulting in meniscus marks. These defects may be avoided through control of the molten steel composition as described above.

Figure 5:
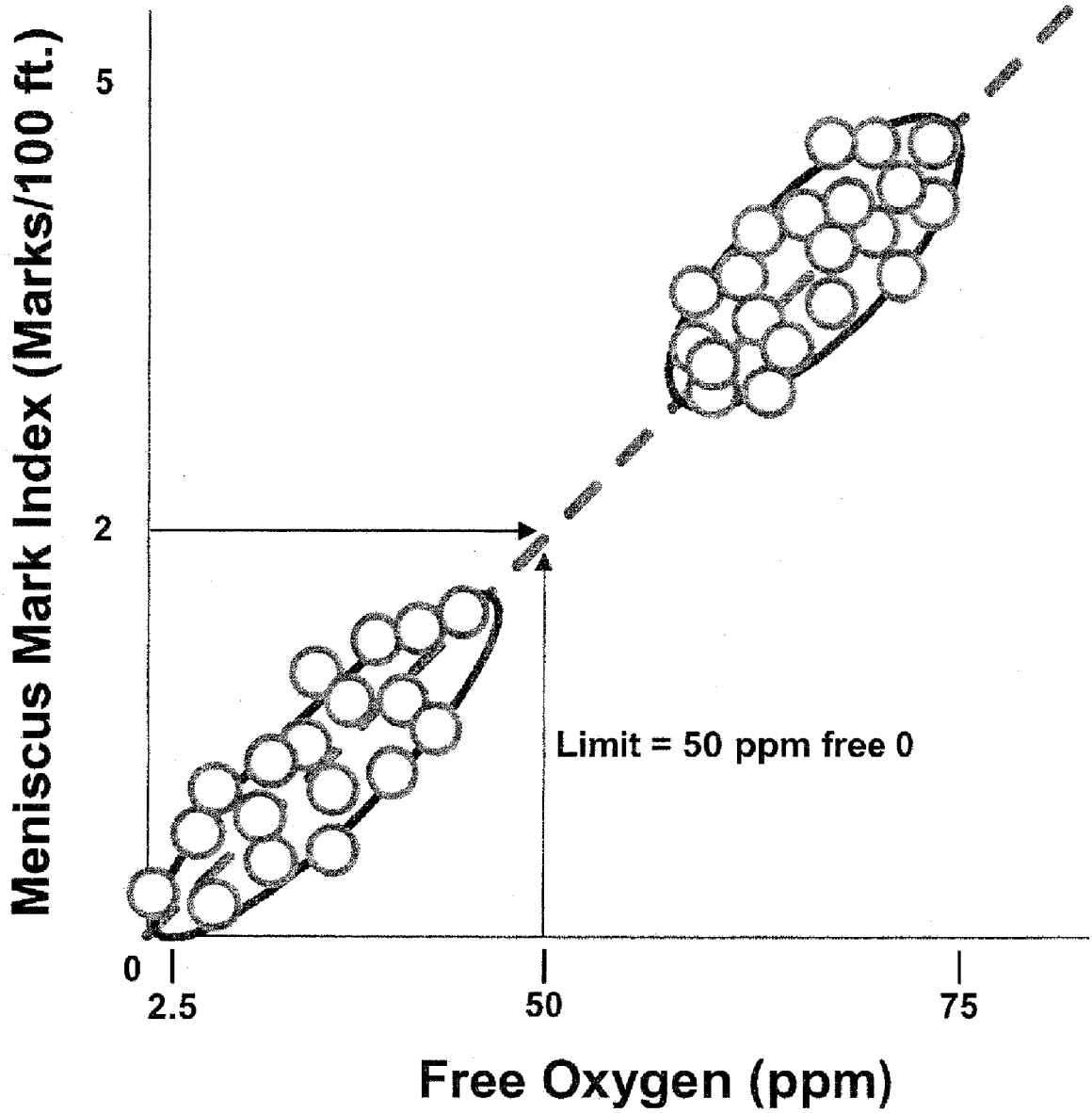
FIG. 5 is a representative chart showing the relationship between the amount of free oxygen and the occurrence of meniscus marks.

As seen in FIG. 5, by maintaining the composition of the molten steel as stated above, an acceptable range of about 2 meniscus marks/100 ft. of thin cast strip, or less, is achieved. It is believed that this is due inhibited surface waves on the surface of the casting pool because of less bubble formation and disturbance in the casting pool with the present composition of molten steel.

The casting surfaces 22A of the casting rolls may have a texture of random projections. This random distribution of discrete projections may be formed on the casting roll surfaces by grit blasting the casting surfaces of the casting rolls before the casting rolls are positioned for casting.

In a further embodiment of the present invention, it has been determined that thin cast strip with reduced meniscus marks can be prepared using molten steel having a carbon content in the range of about 0.03 to about 0.045% by weight, a manganese content between about 0.3 and about 0.8% by weight, a silicon content between about 0.1 and about 0.3% by weight, a calcium content between about 8 ppm and about 40 ppm, an aluminum content between about 10 and about 90 ppm by weight, an amount of chromium resulting from a non-purposeful addition during melting, having a free oxygen content between about 10 ppm and about 40 ppm at about 1600° C.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 90 ppm by weight, a chromium content up to about 10.0% by weight, having a free oxygen content below about 50 ppm at about 1600° C.;

c. forming a casting pool of the molten steel supported on casting surfaces of the casting rolls above the nip; and d. counter-rotating the casting rolls to cause thin strip to be casted downwardly from the nip.

2. The method of casting thin cast strip with reduced meniscus marks as claimed in claim 1 where the molten steel has a carbon content in the range of about 0.03 to about 0.045% by weight, a manganese content between about 0.3 and about 0.8% by weight, a silicon content between about 0.1 and about 0.3% by weight, a calcium content between about 8 ppm and about 40 ppm, an aluminum content between about 10 ppm and about 90 ppm by weight, an amount of chromium resulting from a non-purposeful addition during melting, having a free oxygen content between about 10 ppm and about 40 ppm at about 1600° C.

3. The method of casting thin cast strip with reduced meniscus marks as claimed in claim 1 where the casting surfaces of the casting rolls are textured with a grit blast texture.

4. A method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.3 and about 0.8% by weight, a silicon content between about 0.05 and about 0.5% by weight, a calcium content between about 8 ppm and about 40 ppm, an aluminum content between about 2 ppm and about 90 ppm by weight, a chromium content up to about 10.0% by weight, having a free oxygen content below about 50 ppm at about 1600° C.;

c. forming a casting pool of the molten steel supported on casting surfaces of the casting rolls above the nip; and d. counter-rotating the casting rolls to cause thin strip to be casted downwardly from the nip.

5. A method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.1 and about 2.0% by weight, a silicon content between about 0.05 and about 0.5% by weight, a calcium content between about 8 ppm and about 40 ppm, an aluminum content between about 2 ppm and about 90 ppm by weight, a chromium content up to about 10.0% by weight, having a free oxygen content between about 10 and about 40 ppm at about 1600° C.;

c. forming a casting pool of the molten steel supported on casting surfaces of the casting rolls above the nip; and d. counter-rotating the casting rolls to cause thin strip to be casted downwardly from the nip.

6. A method for making a thin cast strip with reduced meniscus marks comprising the steps of:

a. assembling a pair of casting rolls laterally positioned to form a nip therebetween;

b. preparing molten steel having a carbon content in the range of about 0.01 to about 0.3% by weight, a manganese content between about 0.3 and about 0.8% by weight, a silicon content between about 0.05 and about 0.5% by weight, a calcium content between about 8 ppm and about 40 ppm, an aluminum content between about 2 ppm and about 90 ppm by weight, a chromium content up to about 10.0% by weight, having a free oxygen content between about 10 and about 40 ppm at about 1600° C.;

c. forming a casting pool of the molten steel supported on casting surfaces of the casting rolls above the nip; and d. counter-rotating the casting rolls to cause thin strip to be casted downwardly from the nip.

* * * * *